United States Patent [19]

Kurahashi et al.

[11] Patent Number: 4,519,750

[45] Date of Patent: May 28, 1985

[54] VARIABLE-DELIVERY REFRIGERANT COMPRESSOR

[75] Inventors: Masayuki Kurahashi, Nagoya; Hisao Kobayashi; Hiroyuki Deguchi, both of Kariya, all of Japan

[73] Assignee: Kabushiki Kaisha Toyoda Jidoshokki Seisakusho, Kariya, Japan

[21] Appl. No.: 556,163

[22] Filed: Nov. 29, 1983

[30] Foreign Application Priority Data

Dec. 20, 1982 [JP] Japan ..... 57-224573

[51] Int. Cl.[3] ..... F04B 1/26; F04B 49/02

[52] U.S. Cl. ..... 417/270; 417/296

[58] Field of Search ..... 417/269, 270, 296–298, 417/282

[56] References Cited

U.S. PATENT DOCUMENTS

| | | | |
|---|---|---|---|
| 2,065,199 | 12/1936 | Sexton | 417/298 |
| 2,626,099 | 1/1953 | Ashley | 417/298 |
| 2,682,227 | 6/1954 | Burris | 417/297 |
| 3,040,969 | 6/1962 | Nicholas | 417/298 |
| 3,552,137 | 1/1971 | Christenson | 417/282 |
| 4,403,921 | 9/1983 | Kato | 417/296 |

FOREIGN PATENT DOCUMENTS

| | | | |
|---|---|---|---|
| 195884 | 12/1982 | Japan | 417/270 |

*Primary Examiner*—William L. Freeh

*Attorney, Agent, or Firm*—Browdy and Neimark

[57] ABSTRACT

A variable-delivery refrigerant compressor wherein the delivery of a compressed refrigerant is adjustable by an actuator which is movable with a discharge pressure of the compressor between a first position at which plural discharge valves corresponding to compression chambers are rendered operative, and a second position at which at least one of the discharge valves is rendered inoperative. A pilot switch valve is disposed in a passage through which the discharge pressure is applied to the actuator. The switch valve controls a supply of refrigerant of the discharge pressure to the actuator such that the actuator is placed in the first position while a suction pressure of the compressor is relatively high, and in the second position while the suction pressure is relatively low.

16 Claims, 11 Drawing Figures

FIG. 9
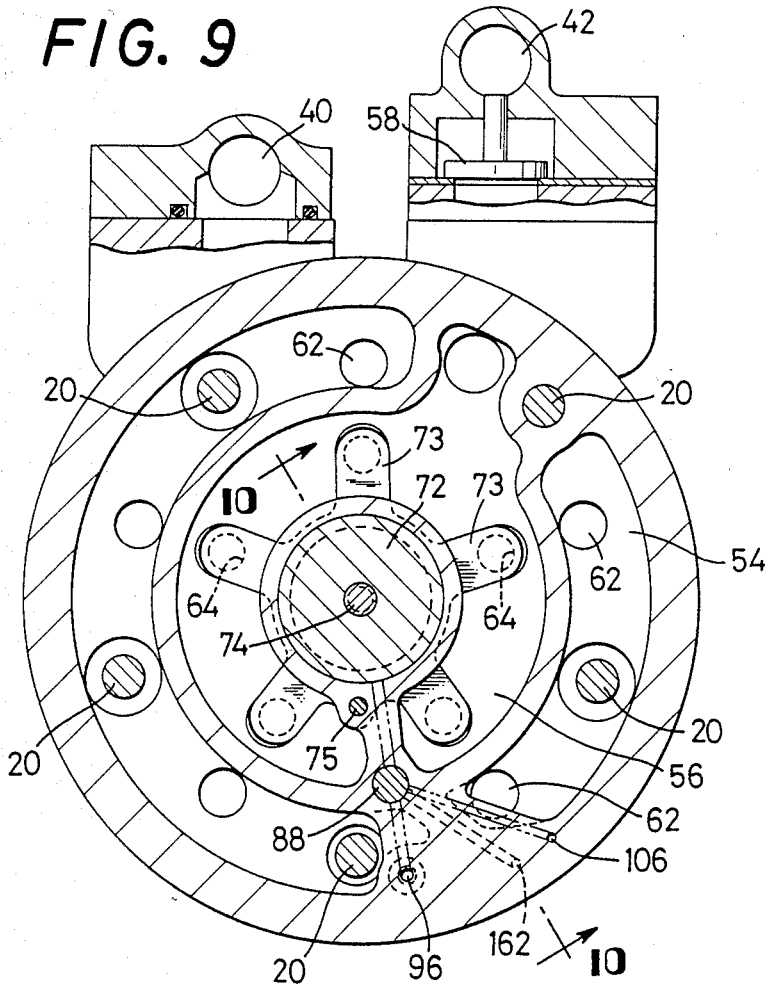
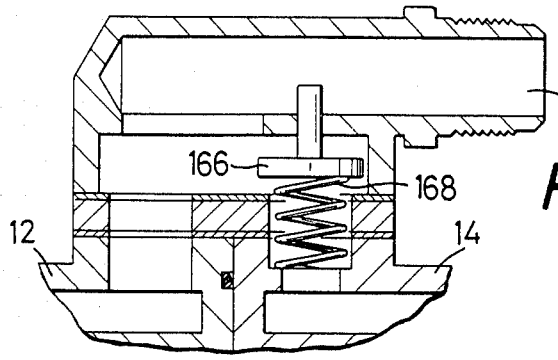
FIG. 11

VARIABLE-DELIVERY REFRIGERANT COMPRESSOR

BACKGROUND OF THE INVENTION

The present invention relates in general to a refrigerant compressor for air-conditioning or similar systems, and more particularly to a variable-delivery refrigerant compressor which is capable of automatic adjustment of compression capacity or displacement by rendering inoperative selected one or some of plural discharge valves which correspond to respective plural compression chambers.

Such type of variable-delivery compressor is known according to a laid-open publication No. 57-73877 of a Japanese Patent Application filed in the name of the assignee of the present application. In the compressor disclosed in this publication, there is disposed an actuator which is movable between its normal and shifted positions. With the actuator held in its normal position, all of plural discharge valves of the compressor are rendered operative to perform their normal valving function. In the shifted position, selected one or some of the discharge valves are rendered inoperative. The actuator is biased by a spring toward its shifted position for low-capacity operation of the compressor, and moved from its shifted position toward its normal position by a discharge pressure of the compressor against a biasing force of the spring so that the delivery of the compressor is increased to its high-capacity level.

In the compressor of the type described above, a solenoid switch valve is employed to control a supply of refrigerant of a discharge pressure to the actuator. The use of the solenoid switch valve inherently increases weight and cost of manufacture of the compressor, and needs electrical controls for actuating the solenoid to operate the valve according to variation in the delivery required, thus requiring the input of a considerable amount of electric energy.

The above inconveniences of the compressor known in the art will be encountered also in the following arrangements which the present applicants regard as alternatives to the above-discussed known arrangement wherein discharge valves are moved axially of the compressor between their normal and shifted positions. The first possible alternative is an arrangement wherein discharge valves are shifted laterally from their normal operative position opposite to corresponding discharge ports to their inoperative position which is spaced from the operative position radially or circumferentially of the compressor. The second alterative may be an arrangement for preventing discharge valves in their open position from returning to their closed position and thereby disabling then to perform their normal valving function, rather than shifting the discharge valves themselves. As another alternative arrangement, it is possible that a spring-biased single-acting cylinder used in the known actuator be replaced by a double-acting cylinder with a piston which receives a discharge pressure of the compressor selectively at one of their opposite faces. Another possibility of modification is to use a rotary actuator in place of a linearly operated actuator used in the known compressor. As pointed out before, all of these alteratives which come into the applicants' mind suffer the same inconveniences as experienced by the known compressor.

SUMMARY OF THE INVENTION

It is accordingly an object of the present invention to provide a variable-delivery refrigerant compressor which includes an actuator movable, through application thereto of a discharge pressure of the compressor, between a first position permitting normal valving function of all discharge valves corresponding to plural compression chambers, and a second position at which at least one of the discharge valves is disabled to perform the normal valving function, and wherein the application of the discharge pressure to the actuator is regulated by a simple control device without using a solenoid-operated switch valve.

Another object of the invention is to provide such variable-delivery refrigerant compressor which is light-weighed, economical to manufacture and requires no consumption of electric power to control the actuator.

According to the present invention, there is provided a variable-delivery refrigerant compressor having a plurality of compression chambers in which a refrigerant gas is compressed for delivery thereof from the compressor. The compressor further has discharge valves disposed corresponding to the respective compression chambers, and an actuator which is movable between its first position at which all of the discharge valves are rendered operative to perform their normal valving function, and its second position at which at least one of the discharge valves is rendered inoperative. The compressor comprises means for defining a passage through which a discharge pressure of the compressor is applied to the actuator, and a pilot switch valve disposed in the passage to control a supply of refrigerant gas of the discharge pressure to the actuator and thereby operate the actuator between the first and second positions, such that the actuator is placed in the first position while a suction pressure of the compressor is relatively high, and in the second position while the suction pressure is relatively low. The compressor further comprises a check valve disposed between a discharge chamber associated with said at least one discharge valve and an outlet port of the compressor from which the compressed refrigerant gas is delivered. The check valve blocks a flow of the refrigerant gas in a direction from the outlet port toward the discharge chamber.

In one form of the invention, the pilot switch valve includes a valve spool which is biased by a spring in one direction and receives a first pilot pressure acting thereon in said one direction, and a second pilot pressure acting thereon in a direction opposite to said one direction. The first pilot pressure is a pressure of the refrigerant gas on the suction side of the compressor, and the second pilot pressure is a pressure of the refrigerant gas under compression in one of the compression chambers the discharge valves of which are not rendered inoperative by the actuator. A biasing force of the spring is determined so as to hold the actuator in its first position while an operating force of the valve spool caused by a difference of the second pilot pressure from the second pilot pressure is greater than said biasing force of the pilot pressure is greater than said biasing force of the spring, and so as to hold the actuator in its first position while the operating force of the valve spool is smaller than the biasing force.

In another form of the invention, the pilot switch valve includes a valve spool which is biased by a spring and an atmospheric pressure in one direction and receives a pilot pressure acting thereon in a direction opposite to said one direction. The pilot pressure is a pressure of the refrigerant gas on the suction side of the compressor. A biasing force of the spring is determined so as to hold the actuator in its first position while a force based on the pilot pressure is greater than a sum of the biasing force of the spring and a force based on the atmospheric pressure, and to hold the actuator in its second position while the force based on the pilot pressure is smaller than the sum.

In accordance with either form of the invention described above, any solenoid-controlled switch valve and an electric control device for the switch valve are not required for regulating the application of a discharge pressure of the compressor to the actuator, whereby the weight and cost of manufacture of the compressor as a whole may be reduced and the compressor may be operated economically without an input of an electric energy for activation of the switch valve used for the actuator.

For easy understanding of the pilot switch valve of the instant compressor, attention is directed to the fact that a decrease in load applied to an air-conditioning system or the like connected to a compressor will cause a decrease in the suction pressure of the compressor and also cause a decrease in pressure difference between pressures of the refrigerant under compression and suction in the compression chambers. This decrease in the suction pressure or pressure difference is utilized to actuate the pilot switch valve, so that the delivery of the compressor is automatically controlled according to variation in the load applied to the air-conditioner or other device connected to the compressor.

BRIEF DESCRIPTION OF THE DRAWINGS

The above and other objects, features and advntages of the present invention will become more apparent from reading the following description of the preferred embodiments taken in connection with the accompanying drawings in which:

FIG. 9 is a cross sectional view similar to FIG. 2, taken along line 9—9 of FIG. 8;

FIG. 11 is a fragmentary view showing a modified form of a check valve.

DETAILED DESCRIPTION OF THE PREFERRED EMBODIMENTS

Figure 1:
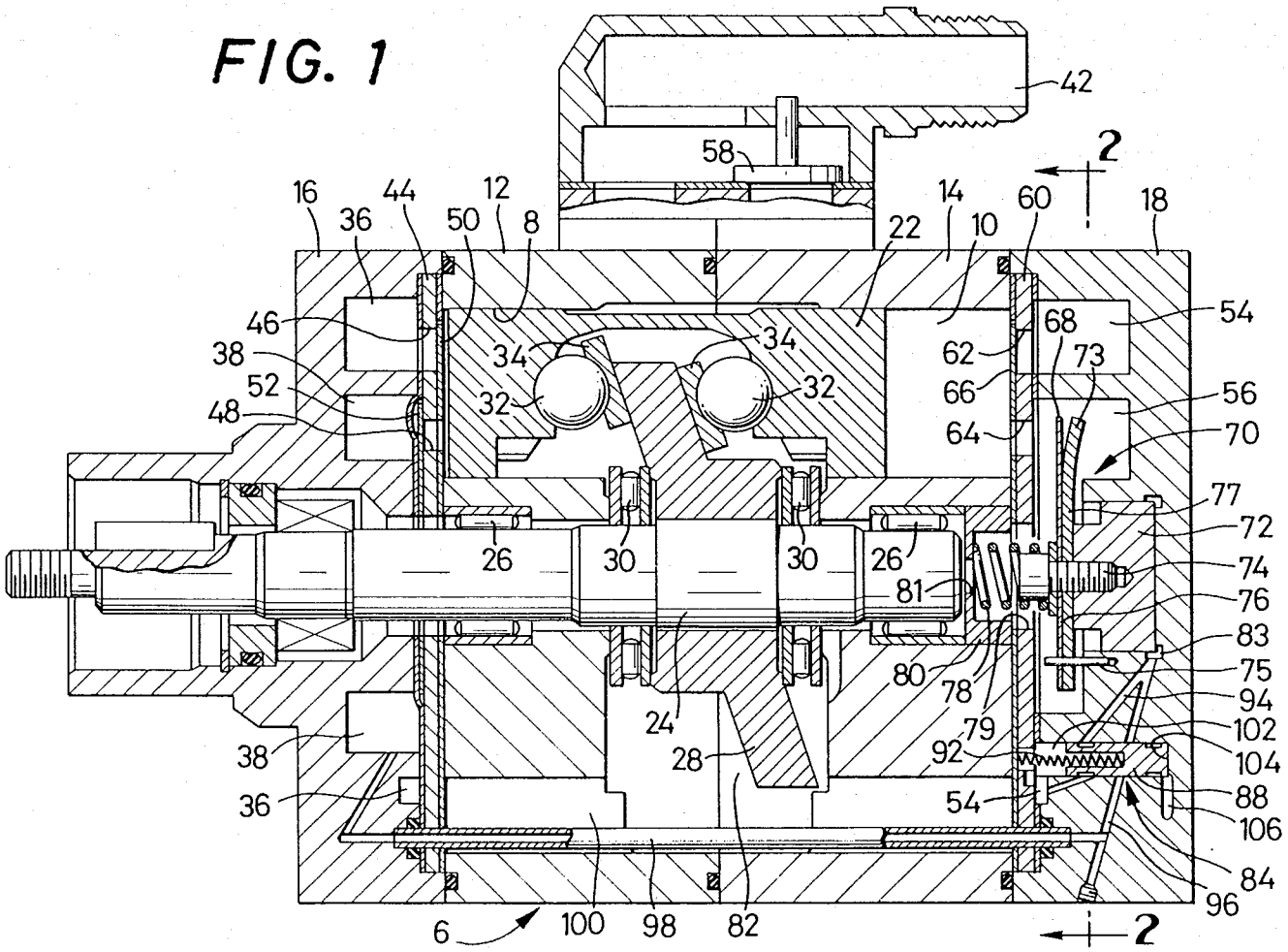
FIG. 1 is a front elevational view in cross section of one embodiment of a variable-delivery refrigerant compressor of swashplate type constructed according to the present invention.
Figure 2:
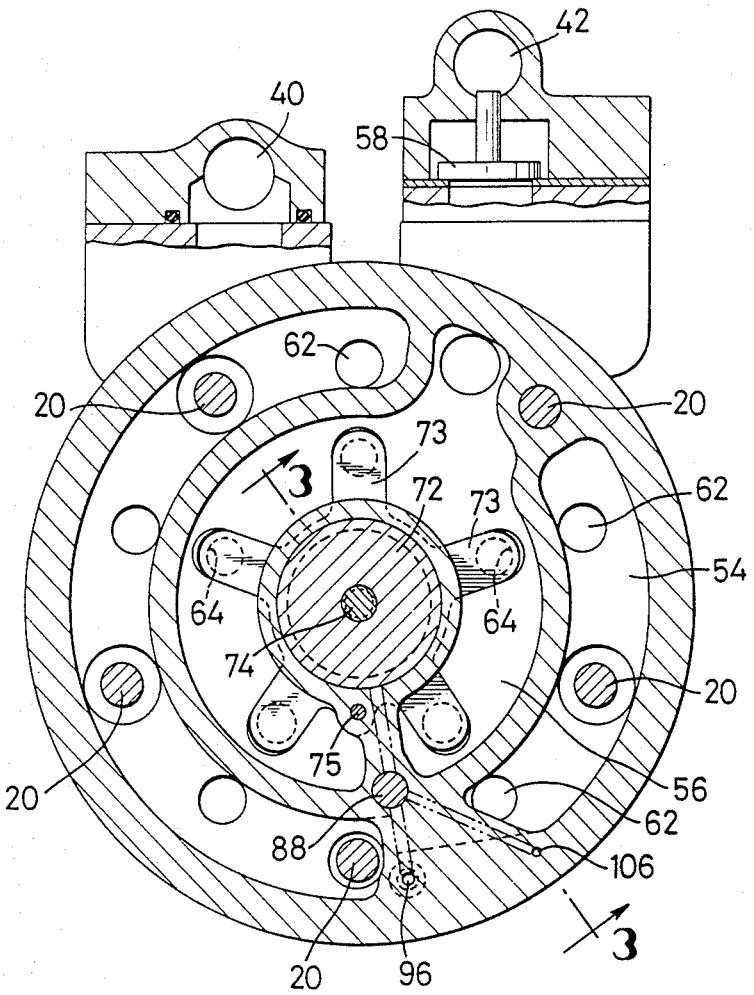
FIG. 2 is a cross sectional view taken along line 2—2 of FIG. 1.
Figure 3:
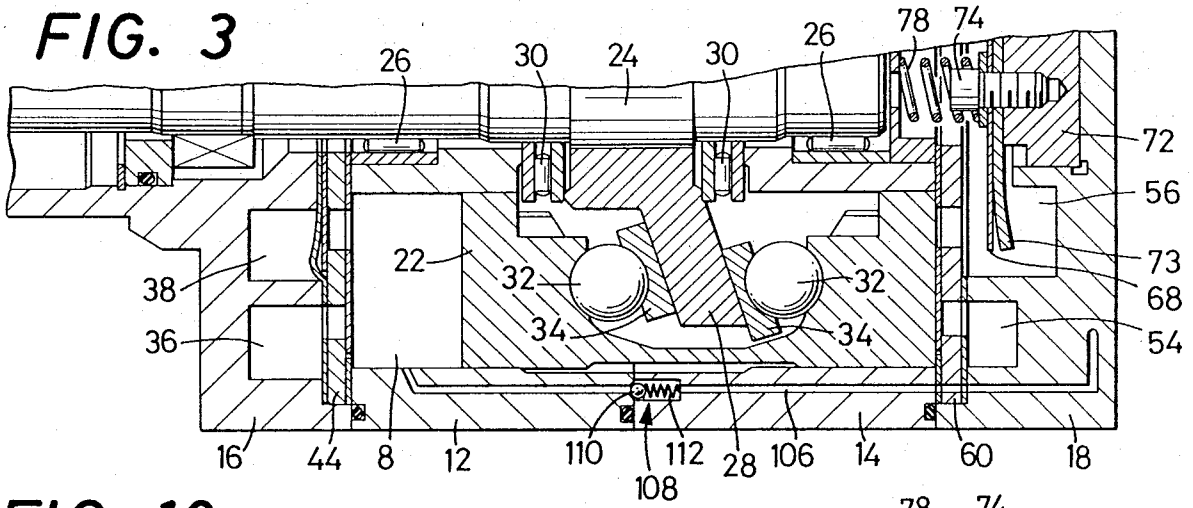
FIG. 3 is a cross sectional view taken along line 3—3 of FIG. 2.

Referring first to FIGS. 1 through 4, there is shown an embodiment of a swashplate type refrigerant compressor of this invention which is applied to an air-conditioning system for an automotive vehicle. As clearly illustrated in FIG. 1, the compressor has a cylinder block 6 which consists of front and rear halves 12 and 14. The front half 12 has five front compression chambers 8, and the rear half 14 has five rear compression chambers 10 which are concentric with the front compression chambers 8. Opposite ends of the cylinder block 6 are closed by respective front and rear housings 16, 18 which are secured to the cylinder block 6 with connecting bolts 20 shown in FIG. 2, whereby a housing assembly of the compressor is constituted. The concentric front and rear compression chambers 8 and 10 in the front and rear halves 12 and 14 of the cylinder block 6 are equally spaced from each other circumferentially of the cylinder block 6. Double-headed pistons 22 are slidably fitted in the respective concentric compression chambers 8, 10. A rotor 24 extends through central portions of the front and rear cylinder block halves 12 and 14 and of the front housing 16, and is rotatably supported by the front and rear halves 12, 14 through respective radial bearings 26. On an axially central portion of the rotor 24, there is secured a swashplate 28 such that its movements along the length of the rotor 24 are prevented by two thrust bearings 30 fixed to the rotor 24. Between each of the double-headed pistons 22 and the swashplate 28, there are disposed two pairs of balls 32 and two pairs of slipper shoes 34, so that the piston 22 is axially movable in a reciprocatory manner within the compression chambers 8, 10 with the balls 32 and shoes 34 in sliding contact with the piston 22 and the swashplate 28 respectively when the swashplate 28 is rotated.

The front housing 16 has a suction chamber 36 and a discharge chamber 38. The suction chamber 36 is held in fluid communication with an inlet port 40 shown in FIG. 2 through a passage not shown. Similarly, the discharge chamber 38 communicates with an outlet port 42 also shown in FIG. 2 through another passage not shown. The suction and discharge chambers 36 and 38 communicate with the individual front compression chambers 8 through suction and discharge ports 46 and 48 which are formed in a valve plate 44 interposed between the front housing 16 and the front cylinder block half 12. The suction ports 46 are provided with suction valves 50, and the discharge ports 48 with discharge valves 52.

On the other hand, the rear housing 18 has a suction chamber 54 and a discharge chamber 56. Like the front suction and discharge chambers 36, 38, these rear suction and discharge chambers 54, 56 are held in fluid communication with the inlet and outlet ports 40, 42, respectively. However, the rear discharge chamber 56 communicates with the outlet port 42 via a check valve 58 disposed in a passage connecting the chamber 56 and the port 42. Further, this rear side of the cylinder block 6 is also provided with a valve plate 60, suction ports 62, discharge ports 64 and suction valves 66 of the same arrangement as on the front side. Unlike the front discharge valves 52, rear discharge valves 68 are adapted to be movable axially of the rotor 24 between the normal operative position at which the valves 68 are held in close contact with the valve plate 60, and the shifted position at which the valves 68 are spaced from the valve plate 60. More specifically stated, the rear housing 18 has at its central portion a control cylinder 70 which includes a piston 72 movable between its first and second positions. The discharge valves 68 are fixed to the piston 72 together with respective valve adjusting members 73 by fixing screws 74. The discharge vales and the adjusting members 73 are integral at their base and extend radially of the control cylinder 70, so that the free ends of the individual discharge valves and adjusting members 68, 73 are circumferentially located opposite to the respective discharge ports 64 which correspond to the five rear compression chambers 10. These circumferential positions of the discharge valves 68 and adjusting members 73 are maintained by a locator pin 75 which is fixed to the rear housing 18 such that it slidably penetrates through the thickness of the circular base portions 76, 77 of the discharge valves 68 and adjusting members 73 at which their radial portions are united to each other. Thus, the valves 68 and the adjusting members 73 are movable with their circumferential positions maintained. The piston 72 is biased by a compression coil spring 78 so as to be normally held in its second position at which the discharge valves 68 are spaced from the valve plate 60 and inoperative, i.e., disabled to perform their normal valving function. The coil spring 78 extends through an opening 79 formed in the center of the valve plate 60, and is supported at one end thereof by a spring seat 80 which has a through-hole 81. The discharge chamber 56 communicates with a swashplate chamber 82 through the through-hole 81 and the opening 79. The circular base portion 76 of the discharge valves 68 serves as a valve which closes the opening 79 and thereby cuts off the fluid communication between the discharge chamber 56 and the swashplate chamber 82 when the base portion 76 is brought into contact with the valve plate 60 by the movement of the piston 72 to its first position.

The control cylinder 70 has a pressure chamber 83 which normally receives a suction pressure in the rear suction chamber 54. Upon switching action of a pilot switch valve 84, a discharge pressure in th front discharge chamber 38 is applied to the pressure chamber 83, and the piston 72 is advanced toward its first position against a biasing force of the coil spring 78, whereby the discharge valves 68 are brought into contact with the valve plate 60, i.e., moved to their normal operative position at which they cooperate with the valve plate 60 to perform their normal valving fucntion.

The pilot switch valve 84 will be described next. This valve 84 includes a valve spool 88 which is slidably received within a blind hole formed in the rear housing 18. The valve spool 88 is biased by a compression coil spring 92 so that it is normally held at its low-pressure supply position of FIG. 1 at which the suction chamber 54 and the pressure chamber 83 of the control cylinder 70 are held in fluid communication with each other through a passage 94, but at which a passage 96 communicating with the discharge chamber 38 and the pressure chamber 83 is disconnected. Indicated at 98 is a conduit forming a part of the passage 96, which bridges the front and rear housings 16 and 18 in a fluid-tight manner and extends through an oil reservoir 100 at the bottom of the compressor. On one side of the valve spool 88, there is provided a first pilot pressure chamber 102 which communicates with the suction chamber 54. A second pilot pressure chamber 104 on the other side of the valve spool 88 communicates with one of the front compression chambers 8 through a passage 106 most clearly shown in FIG. 3. This passage 106 is formed extending through the rear housing 18, valve palte 60, rear and front halves 14 and 12 of the cylinder block 6, etc. In the passage 106 is disposed a check valve 108 comprising a ball 110 and a compression coil spring 112 which are both accommodated in a blind hole formed in a portion of the rear cylinder block half 14 adjacent the mating surface of the front half 12. The ball 110 is urged by the coil spring 112 onto a chamfered surface on the front half 12 at the open end of the blind hole which constitutes a part of the passage 106.

The swashplate refrigerant compressor constructed as discussed heretofore is coupled to and driven by an engine of the vehicle through a clutch not shown. When the clutch is disconnected, the compressor is placed in the condition as shown in FIG. 1. In more detail, the check valve 58 is closed, the discharge valves 68 are all held in their shifted inoperative position with the piston 72 of the control cylinder 70 in its second position, and the pilot valve 84 keeps the pressure chamber 83 of the cylinder 70 in communication with the suction chamber 54.

Upon engagement of the clutch in this condition, the rotor 24 is rotated with the swashplate 28, causing the piston 22 to reciprocate. As a result, the refrigerant gas introduced from the inlet port 40 is sucked into each of the compression chambers 8, 10 through the suction chambers 36 and 54. The sucked refrigerant gas is discharged into the discharge chambers 38 and 56. While the compressed refrigerant gas discharged into the discharge chamber 38 is forced into the air-conditioning system through the outlet port 42, the refrigerant gas discharged into the discharge chamber 56 is re-sucked into the rear compression chambers 10 because the discharge valves 68 are located in their shifted inoperative position. Thus, no substantial compression of the refrigerant gas is effected in the rear compression chambers 10. In other words, in the intial period of operation of the compressor, only the front side of the cylinder block 6 is assigned to effect a compressing operation, so that the vehicle engine is not subject to a sudden application of a high load immediately after the start of the compressor.

When the refrigerant pressure within the front compression chambers 8 has been increased beyond a given level during the compressing operation on the front side, the valve spool 88 is moved to its high-pressure supply position against a biasing force of the coil spring 92 by the refrigerant pressure in one of the front compression chambers 8 which is applied to the second pilot pressure chamber 104 of the switch valve 84 through the passage 106 and the check valve 108. In consequence, the passage 94 is disconnected, and the passage 96 which has been disconnected is connected so that the pressure in the front discharge chamber 38 is applied to the pressure chamber 83 of the control cylinder 70. The piston 72 of the control cylinder 70 is therefore forced into its first position to move the discharge valves 68 to their normal operative position, whereby the compressor enters its full 100%-capacity phase of the compressing operation. In the meantime, the circular base portion 76 of the discharge valves 68 is brought into close contact with the valve plate 60 to close the opening 79 formed in the latter, whereby the communication between the discharge chamber 56 and the swashplate chamber 82 is disconnected. Since the swashplate chamber 82 is held in communication with the inlet port 40, the pressure in a space within the spring seat 80 which has been separated from the discharge chamber 56 becomes equal to the suction pressure of the compressor. Consequently, the piston 72 is subject to the suction pressure via the circular base portions 76, 77 of the discharge valves 68 and the adjusting members 73. With the discharge valves 68 held in their normal operataive position as discussed above, the compressing operation is effected also on the rear side of the compressor. The area of a surface of the piston 72 to which the pressure in the discharge chamber 56 is applied, is designed to be smaller than the area of a surface of the piston 72 to which the pressure in the pressure chamber 82 is applied. Hence, an increase in the pressure in the discharge chamber 56 will not cause the piston 72 to be pushed back to its second position against the discharge pressure in the pressure chamer 83. Thus, the compressor continues its full 100%-capacity operation until the compartment in the vehicle has been cooled down to a comfortable temperature level, i.e., this temperature level is reached within a relatively short period of time because of the 100%-capacity compressing operation.

After the temperatue in the vehicle compartment has been lowered to the comfortable level, the cooling load applied to the air-conditioner is comparatively low as the air-conditioner is required just to keep that comfortable temperature. Therefore, an expansion valve of the air-conditioner is operated toward its closed position, and the refrigerant pressure on the suction side of the compressor is reduced. As a result, the valve spool 88 is moved back to its low-pressure supply position of FIG. 1. The reason for this movement is as follows:

Suppose a volume $V_1$ of refrigerant is sucked into the compressor at a suction pressure $P_1$, and compressed int a volume $V_2$ of a pressure $P_2$, their relation is expressed by the following equation:

$$P_1 V_1^n = P_2 V_2^n$$

Therefore, the pressure $P_2$ is obtained as follows:

$$P_2 = P_1 (V_1/V_2)^n$$

Thus, an increment $\Delta P$ in the pressure by the compression is obtained by the following equation:

$$\Delta P = P_2 - P_1 = P_1[(V_1/V_2)^n - 1]$$

This equation indicates that the pressure increment $\Delta P$ is increased as the suction pressure $P_1$ is increased if the compression ratio $V_1/V_2$ is constant. Therefore, when the suction pressure in the suction chambers 36, 54 is reduced, there arises a decrease in the difference between the pressure in the suction chamber 54 applied to the first pilot pressure chamber 102 and the pressure under compression in one of the compression chambers 8 applied to the second pilot pressure chamber 104. In this condition, it becomes impossible to hold the valve spool 88 at its high-pressure supply position of FIG. 4 against the biasing pressure of the coil spring 92, whereby the valve spool 88 is moved back to its low-pressure supply position shown in FIG. 1.

Upon movement of the valve spool 88 back to its its low-pressure supply position, the pressure chamber 83 of the control cylinder 70 is put into communication with the suction chamber 54. This means the pressure in the pressure chamber 83 is lowered and the piston 72 is forced back to its second position of FIG. 1 by the biasing force of the coil spring 78. As a result, the discharge valves 68 are moved to their shifted inoperative position at which they are disabled to perform their normal valving function. Therefore, the compressor is not able to effect the compressing operation in its five rear compression chamber 10. In this 50%-capacity operating condition, the pressure in the discharge chamber 56 is lowered to a level equal to the pressure in the suction chamber 54, and consequently the check valve 58 is closed with a result of blocking a flow of the refrigerant gas in a direction from the outlet port 42 toward the discharge chamber 56.

If the cooling load is subsequently increased and the suction pressure is elevated, the valve spool 88 of the pilot switch valve 84 is moved to its high-pressure supply position against the biasing force of the coil spring 92, and the discharge pressure in the front discharge chamber 38 is applied to the pressure chamber 83 of the control cylinder 70, whereby the discharge valves 68 are moved to their normal operative position for 100%-capacity operation of the compressor. As described hereinbefore, the temperature in the vehicle compartment is maintained at a comfortable level through repetition of the alternate 100%- and 50%-capacity modes of operations of the compressor which are automatically switched from one mode to the other. Therefore, the need for disconnection and re-connection of the clutch between the engine and the compressor is substantially reduced and the service life of the clutch is considerably elongated, as compared with the traditional arrangement wherein a clutch itself is utilized as means for controlling the delivery of a compressor.

As is apparent from the foregoing description, the biasing force of the coil spring 92 is determined so as to hold the piston 72 in its first position while an operating force of the valve spool 88 caused by a difference of the pressure in the second pilot chamber 104 from the pressure in the first pilot chamber 102 is greater than the biasing force of the spring 92, and so as to hold the piston 72 in its second position while the operating force of the valve spool 88 is smaller than the biasing force of the spring 92.

While the present embodiment of the compressor uses the check valve 108 in the passage 106, the function of this check valve 108 is to prevent a decrease in the second pilot pressure chamber 104 of the switch valve 84 when the front compression chamber 8 communicating with the passage 106 is under a sucking operation, and to maintain the pressure in the chamber 104 at a peak pressure at a portion of the compression chamber 8 adjacent the open end of the passage 106. However, the switch valve 84 which is a spool valve can not be perfectly protected against pressure leakage, i.e., not fully gas-tight even if the check valve 108 is provided, whereby the valve spool 88 is sufficiently allowed to move to its low-pressure supply position when the cooling load is decreased, as previously described.

The use of the check valve 108 may be omitted if a chock or restrictor is provided in the passage 106 or if the passage 106 itself is made very narrow. In this instance, the second pilot pressure chamber 104 is subject to a mean average pressure in the front compression chamber 8 adjacent the open end of the passage 106.

Figure 5:
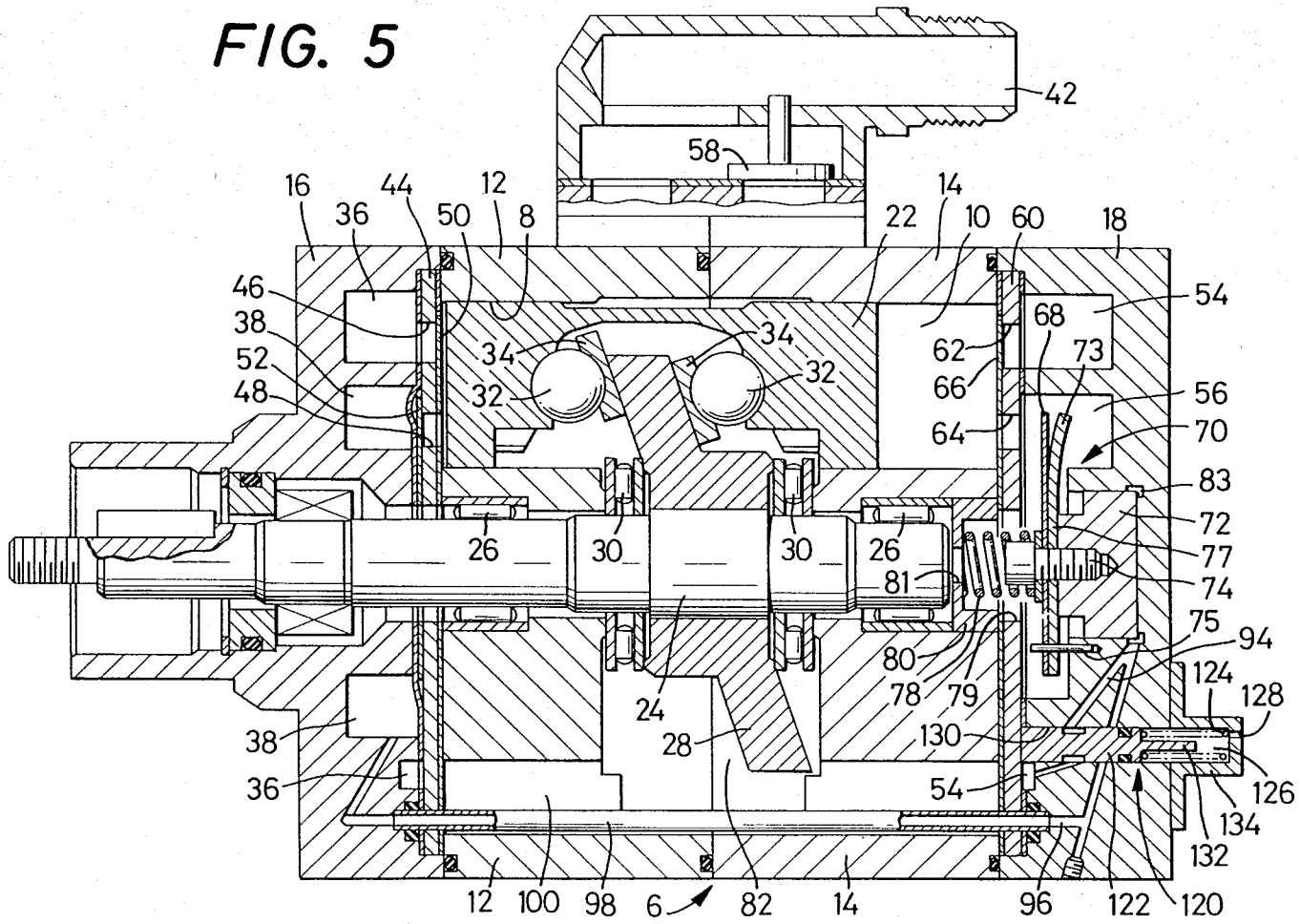
FIG. 5 is a front elevational view in cross section of a second embodiment of the swashplate compressor.

Referring next to FIG. 5, there is illustrated another embodiment of a swashplate type refrigerant compressor according to the invention. The primary difference of this embodiment from the preceding embodiment lies in a pilot switch valve 120 and a manner in which the switch valve 120 is actuated under a pilot pressure. More particularly described, the switch valve 120 includes a valve spool 122 which is biased by a compression coil spring 124 so as to be normally held in its low-pressure supply position shown in FIG. 5. In this position, the valve spool 122 disconnects the passage 96 while it permits the pressure chamber 83 of the control cylinder 70 to communicate with the suction chamber 54 through the passage 94, causing the pressure in the suction chamber 54 to be applied to the pressure chamber 83. The coil spring 124 is received in an air chamber 126 disposed on one side of the valve spool 122. The air chamber 126 communicates with the atmosphere via an orifice 128 formed in a cap 134 which cooperates with the valve spool 122 and the rear housing 18 to define the air chamber 126. A pilot pressure chamber 130 which is provided on the opposite side of the valve spool 122, is held in communication with the suction chamber 54. Thus, the pilot switch valve 120 receives the pressure in the suction chamber 54 as a pilot pressure. The other parts of this embodiment are identical to the corresponding parts of the preceding embodiments. The same reference numerals are used in FIG. 5 to identify the parts identical in function to those of the preceding embodiments, and their detailed description is omitted herein.

While the compressor of FIG. 5 is at rest, pressures in all of the spaces or chambers within the compressor are equal, and consequently the piston 72 of the control cylinder 70 is held by the coil spring 78 in the second position with the discharge valves 68 maintained at their shifted inoperative position, as shown in FIG. 5. In this condition, the valve spool 122 is held in its high-pressure supply position, with its extension 132 abutting on the bottom of the cap 134, by the pressure in the suction chamber 54 which is considerably greater than the atmospheric pressure so that the valve spool 122 in the high-pressure supply position may resist the biasing force of the coil spring 124.

Upon starting of the compressor in this condition, the normal compressing operation is effected on the front side of the compressor, but not on the rear side because the rear discharge valves 68 are located at their shifted inoperative position, whereby the 50%-capacity operation is performed by the compressor in the initial period of operation.

When the pressure in the front discharge chamber 38 has been elevated beyond a certain level during the compressing operation on the front side of the compressor, the piston 72 is advanced against the biasing force of the coil spring 78 to its first position by the elevated pressure in the discharge chamber 38 which is applied to the pressure chamber 83 of the control cylinder 70 through the pressure 96. As a result, the rear discharge valves 68 are forced to their normal operative position, so that the normal compressing operation may be conducted also on the rear side of the compressor. Thus, the 100%-capacity operation mode is started and the vehicle compartment may be cooled at a high rate.

When the vehicle compartment has been cooled down to a preset comfortable temperature and the cooling load applied to the air-conditioner has been reduced because of a low requirement for cooling to maintain the comfortable temperature, the expansion valve of the air-conditioner is operated toward its closed position and the pressure in the suction chamber 54 is reduced. As a result, the spring 124 becomes to overcome the pressure in the suction chamber 54, and the valve spool 122 is moved to the low-pressure supply position shown in FIG. 5. Consequently, the pressure chamber 83 of the control cylinder 70 is put into communication with the suction chamber 54, and the piston 72 is forced back to its second position of FIG. 5 by the biasing force of the coil spring 78 and the pressure in the discharge chamber 56, whereby the rear discharge valves 68 are moved to their shifted inoperative position. Thus, the normal compressing operation on the rear side of the compressor is stopped, and the compressor enters its 50%-capacity mode of operation. As described above, the 100%- and 50%-capacity modes of operation are automatically repeated alternately according to variation in the cooling load applied to the air-conditioner. Therefore, the need for disconnection and re-connection of the clutch is considerably reduced.

As is apparent from the foregoing description, the biasing force of the coil spring 124 is determined so as to hold the piston 72 in its first position while a force based on the pressure in the suction chamber 54 is greater than a sum of the biasing force of the coil spring 124 and a force based on the atmospheric pressure, and so as to hold the piston 72 in its second position while the force based on the pressure in the chamber 54 is smaller than said sum.

Although the valve spool 122 of the present embodiment is held in its high-pressure supply position while the compressor is at rest, it takes an appreciable length of time after the start of the compressor before the piston 72 starts to be moved to its first position by the pressure in the front discharge chamber 38 applied to the pressure chamber 83. Therefore, the rear side of the compressor will not initiate its normal compressing operation simultaneously with the start of the compressor. While this arrangement is not capable of providing a sufficient time lag, as in the preceding embodiment, before the start of the 100%-capacity operation, a similar effect of delay may be accomplished by such arrangement.

While the present invention has been described in connection with its preferred embodiments, the invention is not limited thereto but may be otherwise embodied.

Figure 6:
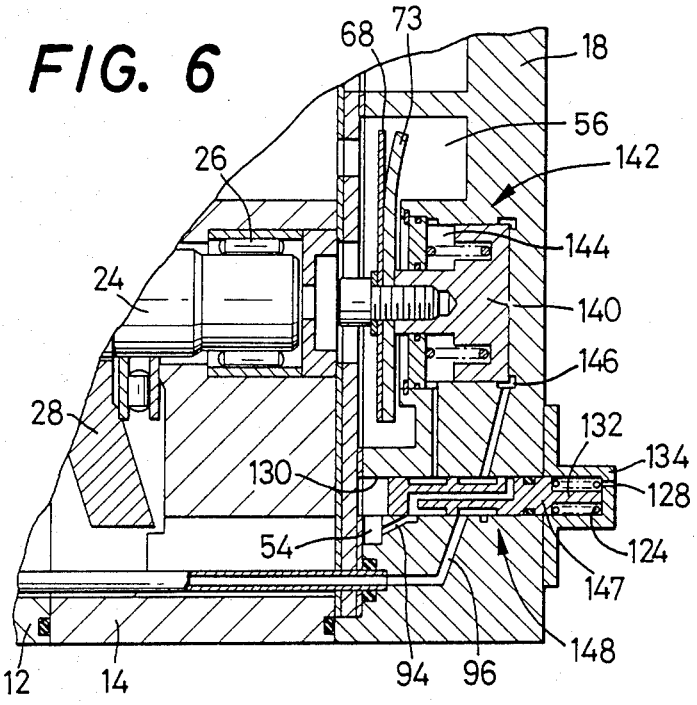
FIGS. 6 and 7 are fragmentary front elevational views in cross section, each showing a part of a compressor which is a modified form within the scope of the second embodiment of FIG. 5.

For example, the compressor may use as an actuator a double-acting cylinder 142 closed at its opposite ends, as shown in FIG. 6. More specifically, the double-acting cylinder 142 has a piston 140 and first and second pressure chambers 144 and 146 on opposite sides of the piston 140. In this modified embodiment, a pilot switch valve 148 including a valve spool 147 is utilized to feed the first and second pressure chambers 144 and 146 selectively with the suction and discharge pressures, to move the rear discharge valves 68 between its normal operative and shifted inoprative positions. While the valve spool 147 is located at one position thereof, the first and second pressure chambers 144 and 146 are placed in communication with the suction and discharge chambers 54 and 38, respectively. With the valve spool 147 at the other position thereof, the pressure chambers 144 and 146 are placed in communication with the discharge and suction chambers 38 and 54, respectively. In other words, the passages 94 and 96 are put into selective communication with the first and second pressure chambers 144 and 146 through movements of the valve spool 147 of the pilot valve 148.

Figure 7:
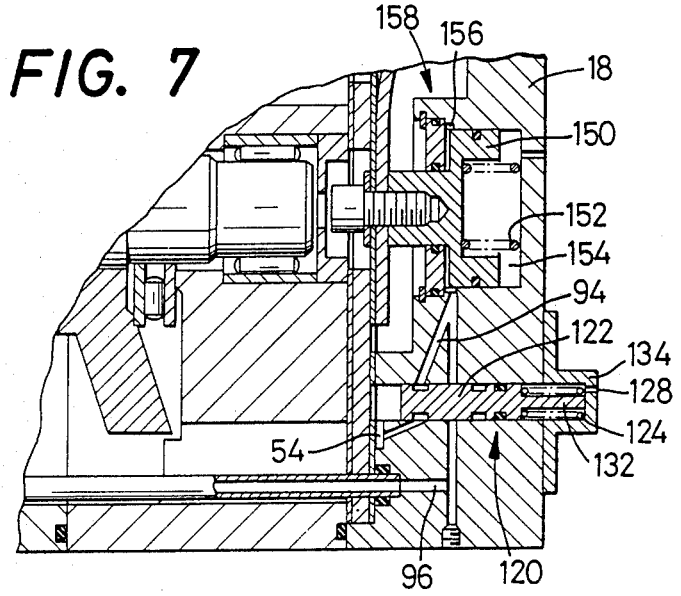

A further modified embodiment is shown in FIG. 7 wherein a single-acting cylinder 158 is used, which includes a piston 150 biased on one side thereof by a compression coil spring 152 so as to be normally held in its first position. An air chamber 154 accommodating the coil spring 152 is kept in communication with the atmospheric pressure. A pressure chamber 156 on the other side of the piston 150 is placed in selective communication with the suction chamber 154 or the front discharge chamber 38 through movements of the valve spool 122. This arrangement also permits an automatic change of operation from the 100%-capacity mode to the 50%-capacity mode in response to the decrease in the cooling load applied to the air-conditioner.

Figure 10:
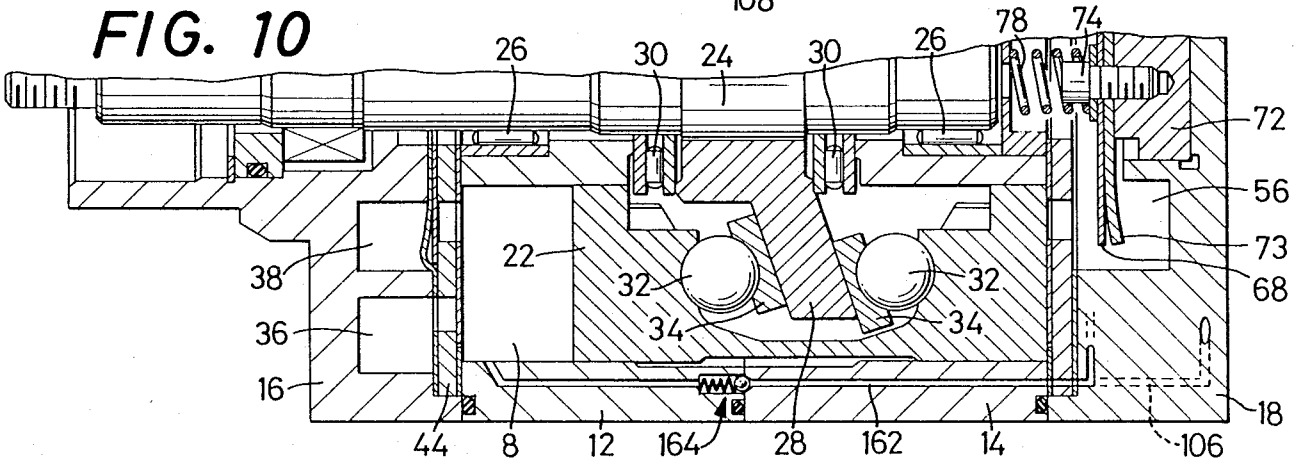
FIG. 10 is a cross sectional view similar to FIG. 3, taken along line 10—10 of FIG. 9.
Figure 4:
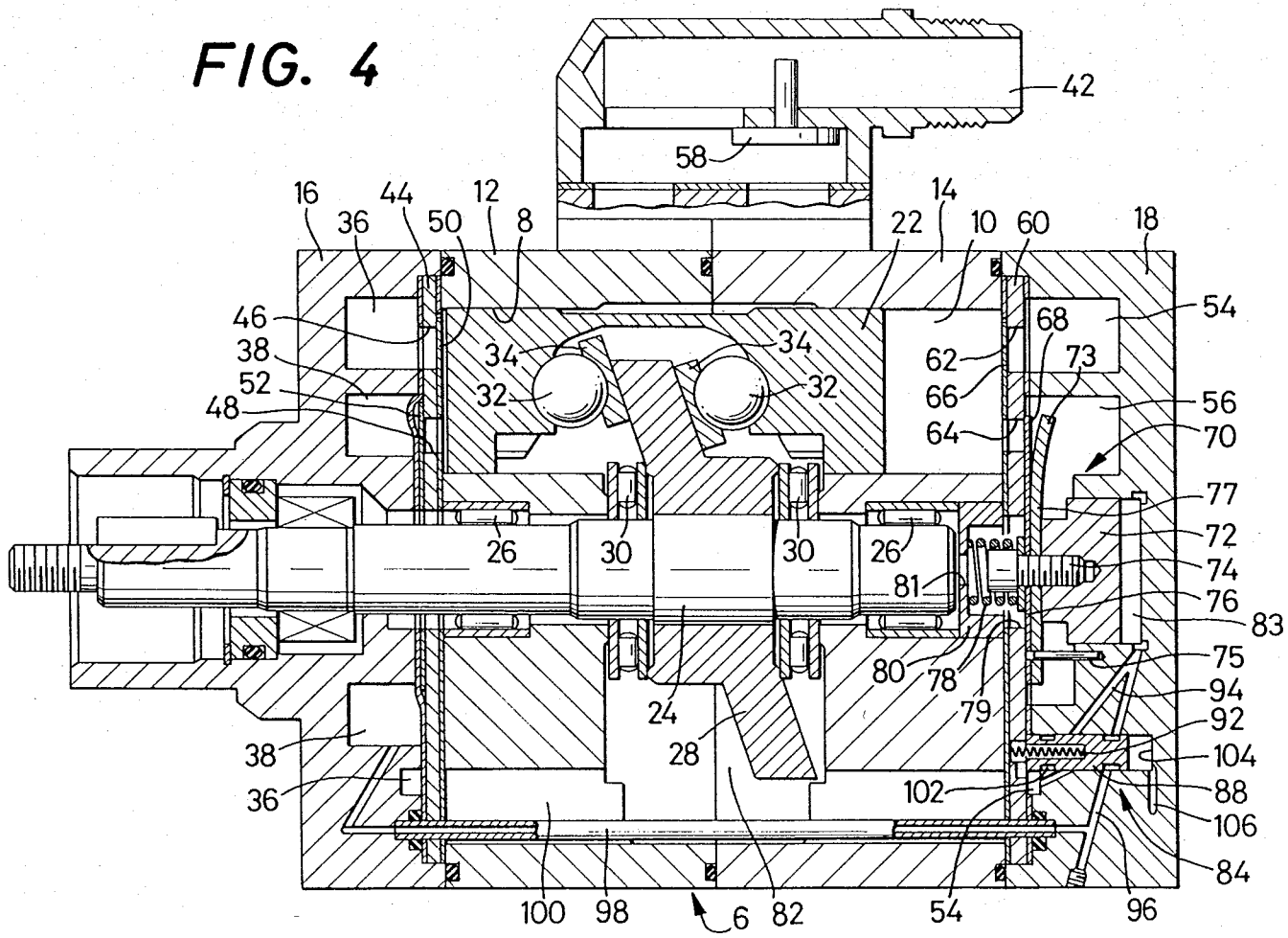
FIG. 4 is a view corresponding to FIG. 1, showing the swashplate compressor placed in its operating state different from that of FIG. 1.
Figure 8:
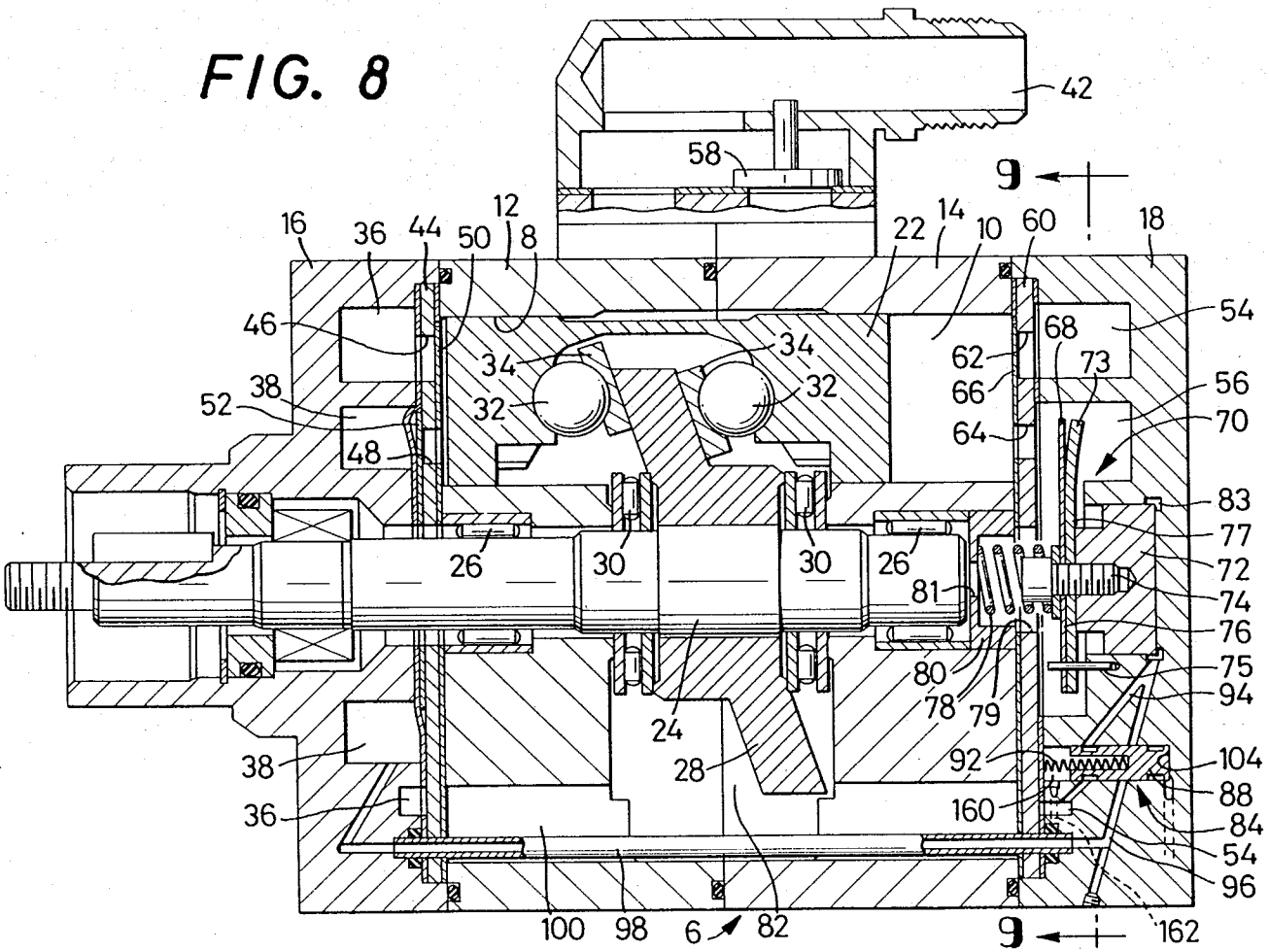
FIG. 8 is a cross sectional view similar to FIG. 1, showing another modified form of the invention.

While the pilot pressure chamber (first pilot pressure chamber) 102, 130 on one side of the valve spool 88, 122, 147 is kept in communication with the rear suction chamber 54 in the previous embodiments, it is possible that the pilot pressure chamber be designed to communicate with one of the compression chambers 8, 10, preferably one of the front compression chambers 8 whose discharge valves 52 are not rendered inoprative, through a check valve, so that the pressure under suction in the appropriate compression chamber 8 (10) is applied to the pilot pressure chamber. An example of such arrangement is shown in FIGS. 8–10, wherein a first pilot pressure chamber 160 is separated from the rear suction chamber 54, but held in communication with one of the front compression chambers 8 through a passage 162 in which a check valve 164 is dispoed. Unlike the check valve 108 shown in FIG. 3, the check valve 164 prevents a flow of the refrigerant in the compression chamber 8 into the first pilot pressure chamber 160 during compression of the refrigerant in the compression chamber 8. At any rate, the pilot switch valve is actuated through a decrease in pressure of the refrigerant gas on the suction side of the compressor in response to a decrease in the cooling load applied, or actuated through a resultant variation in difference between the suction side pressure and the pressure of the refrigerant under compression in one of the front compression chambers 8 (compression chambers whose discharge valves are not rendered inoperative).

Further, it is appreciated that a check valve disposed between the outlet port 42 and the rear discharge chamber 56 be spring-biased so that it is normally slightly open. An example of this arrangement is shown in FIG. 11, wherein a normally slightly open check valve 166 biased by a coil spring 168 permits a flow of the compressed refrigerant from the front discharge chamber 38 into the rear discharge chamber 56 during an initial period of operation of the compressor in which the compressing operation is effected only in the front compression chambers 8. The check valve 166 slightly open with the biasing force of the spring 168 is closed when the flow of the refrigerant toward the rear discharge chamber 56 has exceeded a predetermined limit. In other words, an amount of opening of the check valve is determined such that the check valve 166 is closed when a velocity of the flow of the refrigerant gas from the outlet port 42 (i.e., from the front discharge chamber 38) toward the rear discharge chamber 56 exceeds the predetermined limit. By using this spring-biased check valve 166, a smooth rise of the load torque may be achieved the compressor may be achieved at the start of the compressor, thereby preventing otherwise possible sudden increase in the engine load and consequent degradation in the ride comfort of the vehicle.

The compressor of the present invention is not limited to a swashplate type, but may take any other forms such as a crank type as long as plural compression chambers are provided therein.

It is to be understood that other modifications, changes, and improvements may occur to those skilled in the art without departing from the scope of the present invention defined in the appended claims.

What is claimed is:

1. A variable-delivery refrigerant compressor, comprising:

a plurality of compression chambers in which a refrigerant gas is compressed for delivery thereof from the compressor;

discharge valves disposed corresponding to said compression chambers;

an actuator including a piston movable between a first position thereof at which all of said discharge valves are rendered operative to perform their normal valving function, and a second position thereof at which at least one of said discharge valve is rendered inoperative;

means for defining a first passage through which a discharge pressure of the compressor is applied to said piston of said actuator;

means for defining a second passage through which a suction-side pressure of the refrigerant gas on the suction side of the compressor is applied to said piston of said actuator;

a pilot switch valve disposed in association with said first and second passages, and including a valve spool which receives said suction-side pressure as a pilot pressure and is movable between two positions, to control a mode of application of said discharge pressure and said suction-side pressure to said piston of said actuator, and thereby operate said actuator between said first and second positions, such that said actuator is placed in said first position while a suction pressure of the compressor is relatively high, and in said second position while said suction pressure is relatively low; and a check valve disposed between a discharge chamber associated with said at least one discharge valve and an outlet port of the compressor from which the compressed refrigerant gas is delivered, said check valve blocking a flow of said refrigerant gas in a direction from said outlet port toward said discharge chamber.

2. A variable-delivery refrigerant compressor as set forth in claim 1, wherein said valve spool is biased by a spring and an atmospheric pressure in one direction and receives said suction-side pressure as the pilot pressure acting thereon in a direction opposite to said one direction, a biasing force of said spring being determined so as to hold said actuator in said first position while a force based on said pilot pressure is greater than a sum of said biasing force of said spring and a force based on said atmospheric pressure, and to hold said actuator in said second position while said force based on said pilot pressure is smaller than said sum.

3. A variable-delivery refrigerant compressor as set forth in claim 1, wherein said actuator comprises a single-acting cylinder including said piston, said piston being biased on one side thereby by a spring toward its retracted position and having a chamber on the other side of said piston, said pilot switch valve placing said pressure chamber of said single-acting cylinder in selective fluid communication with a suction chamber of the compressor or one of discharge chambers corresponding to the compression chambers the discharge valves of which are not rendered inoperative by said actuator.

4. A variable-delivery refrigerant compressor as set forth in claim 1, wherein said actuator comprises a double-acting cylinder including said piston and a first and a second pressure chamber on opposite sides of said piston, said pilot switch valve placing said first and second chambers, when said spool is located at one position thereof, in fluid communication respectively with a suction chamber of the compressor and one of discharge chambers corresponding to the compression chambers the discharge valves of which are not rendered inoperative by said actuator, said pilot switch valve placing said first and second pressure chambers in fluid communication respectively with said one of the discharge chambers and said suction chamber when said spool is located at another position thereof.

5. A variable-delivery refrigerant compressor as set forth in claim 1, wherein said actuator comprises a single-acting cylinder including said piston, said piston being biased on one side thereof by a spring and an atmospheric pressure toward its advanced position and having a pressure chamber on the other side of said piston, said pilot switch valve placing said pressure chamber of said single-acting cylinder in selective fluid communication with a suction chamber of the compressor or one of discharge chambers corresponding to the compression chambers the discharge valves of which are not rendered inoperative by said actuator.

6. A variable-delivery refrigerant compressor as set forth in claim 1, wherein said check valve is spring-biased so that it is normally open, an amount of opening of said check valve being determined such that said check valve is closed when a velocity of said flow of the refrigerant gas from said outlet port toward said discharge chamber exceeds a predetermined limit.

7. A variable-delivery refrigerant compressor as set forth in claim 1, wherein said valve spool is biased by a spring in one direction and receives said suction-side pressure as a first pilot pressure acting thereon in said one direction, and a second pilot pressure acting thereon in a direction opposite to said one direction, said second pilot pressure being a pressure of the refrigerant gas under compression in one of the compression chambers the discharge valves of which are not rendered inoperative by said actuator, a biasing force of said spring is determined so as to hold said actuator in said first position while an operating force of said valve spool caused by a difference of said second pilot pressure from said first pilot pressure is greater than said biasing force of said spring, and so as to hold said actuator in said second position while said operating force is smaller than said biasing force.

8. A variable-delivery refrigerant compressor as set forth in claim 7, wherein said suction side pressure of the refrigerant gas on the suction side of the compressor is a suction pressure at which the refrigerant gas is sucked into the compressor.

9. A variable-delivery refrigerant compressor as set forth in claim 7, wherein said suction side pressure of the refrigerant gas on the suction side of the compressor is a pressure of the refrigerant gas under suction in one of the compression chambers.

10. A variable-delivery refrigerant compressor as set forth in claim 9, further comprising means for defining another passage through which said second pilot pressure is applied to said pilot switch valve, and a check valve disposed in said another passage to block a flow of said refrigerant gas from said pilot switch valve toward said one of the compression chambers.

11. A variable-delivery refrigerant compressor as set forth in claim 1, which is of a swashplate type and further comprises:

a front cylinder block having a plurality of front cylinder bores spaced from each other circumferentially of the cylinder block;

a rear cylinder block having a plurality of rear cylinder bores concentric with said front cylinder bores;

double-headed pistons slidably and substantially fluid-tightly fitted in said front and rear cylinder bores, said double-headed pistons cooperating with said front and rear cylinder bores to define respective front and rear compression chambers which constitute said plurality of compression chambers; and a swashplate rotatably supported in said front and rear cylinder blocks and reciprocating said double-headed pistons in said front and rear cylinder bores;

said at least one discharge valve being plural discharge valves associated with said rear compression chambers.

12. A variable-delivery refrigerant compressor as set forth in claim 11, further comprising a rear housing having a rear discharge chamber and a rear suction chamber each of which communicates with said rear compression chambers, said valve spool being received in said rear housing movably between said two positions and exposed at one end thereof to said rear suction chamber.

13. A variable-delivery refrigerant compressor as set forth in claim 2, wherein said valve spool is biased by a spring and an atmosphere in one direction and receives said suction pressure acting thereon in a direction opposite to said one direction, a biasing force of said spring being determined so as to hold said actuator in said first position while a force based on said suction pressure is greater than a sum of said biasing force of said spring and a force based on said atmospheric pressure, and to hold said actuator in said second position while said force based on said suction pressure is smaller than said sum.

14. A variable-delivery refrigerant compressor as set forth in claim 12, wherein said actuator comprises a single-acting cylinder including said piston, said piston being biased on one side thereof by a spring toward its retracted position, said single-acting cylinder having a chamber on the other side of said piston, said pilot switch valve placing said pressure chamber of said single-acting cylinder in selective communication with said rear suction chamber or one of front discharge chambers corresponding to said front compression chambers.

15. A variable-delivery refrigerant compressor as set forth in claim 12, wherein said actuator comprises a double-acting cylinder including said piston, and a first and a second pressure chamber on opposite sides of said piston, said pilot switch valve placing said first and second chambers, when said valve spool is located at one position thereof, in fluid communication respectively with said rear suction chamber and one of front discharge chambers corresponding to the front compression chambers, said pilot switch valve placing said first and second pressure chambers in fluid communication respectively with said one of the front discharge chambers and said rear suction chamber.

16. A variable-delivery refrigerant compressor as set forth in claim 12, wherein said actuator comprises a single-acting cylinder including said piston, said piston being biased on one side thereof by a spring and an atmospheric pressure toward its advanced position, said single-acting cylinder having a pressure chamber on the other side of said piston, said pilot switch valve placing said pressure chamber of said single-acting cylinder in selective fluid communication with said rear suction chamber or one of front discharge chambers corresponding to said front compression chambers.

* * * * *